US008360212B2

(12) United States Patent
Hagg et al.

(10) Patent No.: US 8,360,212 B2
(45) Date of Patent: Jan. 29, 2013

(54) METHOD AND ARRANGEMENT FOR FIXING THE COMPENSATING ROPES OF AN ELEVATOR

(75) Inventors: Jori Hagg, Riihimäki (FI); Razvan Albu, Hyvinkää (FI); Jani Luoma, Vantaa (FI)

(73) Assignee: Kone Corporation, Helsinki (FI)

( * ) Notice: Subject to any disclaimer, the term of this patent is extended or adjusted under 35 U.S.C. 154(b) by 33 days.

(21) Appl. No.: 12/987,643

(22) Filed: Jan. 10, 2011

(65) Prior Publication Data

US 2011/0162915 A1 Jul. 7, 2011

Related U.S. Application Data

(63) Continuation of application No. PCT/FI2009/000075, filed on Aug. 11, 2009.

(30) Foreign Application Priority Data

Aug. 13, 2008 (FI) ..... 20080464

(51) Int. Cl.

| | |
|---|---|
| ***B66B 7/08*** | (2006.01) |
| ***B66B 11/02*** | (2006.01) |
| ***B66B 11/08*** | (2006.01) |
| ***B21D 39/03*** | (2006.01) |

(52) U.S. Cl. ..... 187/411; 187/264; 187/401; 29/428

(58) Field of Classification Search ..... 187/411, 187/264, 401, 404; 29/428, 429, 525.01; *B66B 7/06, 7/00, 11/02; F16G 11/04, 11/09*
See application file for complete search history.

(56) References Cited

U.S. PATENT DOCUMENTS

| | | | | |
|---|---|---|---|---|
| 5,172,782 | A * | 12/1992 | Yoo et al. | 177/147 |
| 5,353,893 | A * | 10/1994 | Sun et al. | 187/412 |
| 5,421,433 | A * | 6/1995 | Yoo | 187/391 |

(Continued)

FOREIGN PATENT DOCUMENTS

| | | | |
|---|---|---|---|
| EP | 1123891 | A2 * | 8/2001 |
| EP | 1884492 | A1 * | 2/2008 |

(Continued)

OTHER PUBLICATIONS

International Search Report for PCT/FI2009/000075 mailed Nov. 9, 2009.

(Continued)

*Primary Examiner* — Michael Mansen
*Assistant Examiner* — Stefan Kruer
(74) *Attorney, Agent, or Firm* — Birch, Stewart, Kolasch & Birch, LLP

(57) ABSTRACT

A method and an arrangement are provided for fixing the compensating ropes of an elevator to an elevator car or to a counterweight, which elevator includes at least a hoisting machine and hoisting roping, suspended by which the elevator car as well as the counterweight are arranged to travel, and between which elevator car and counterweight compensating ropes are fixed such that the first ends of the compensating ropes are fixed to the counterweight, from where the compensating ropes are led downwards to pass below a compensating pulley, after which upwards to the elevator car, where the second ends of the compensating ropes are fixed by wedge housings in connection with the elevator car. When fixing the ends of the compensating ropes in connection with the elevator car or the counterweight, the wedge housings are turned into an inclined attitude before disposing the ends of the compensating ropes in the wedge housings.

17 Claims, 3 Drawing Sheets

U.S. PATENT DOCUMENTS

Figure 1:
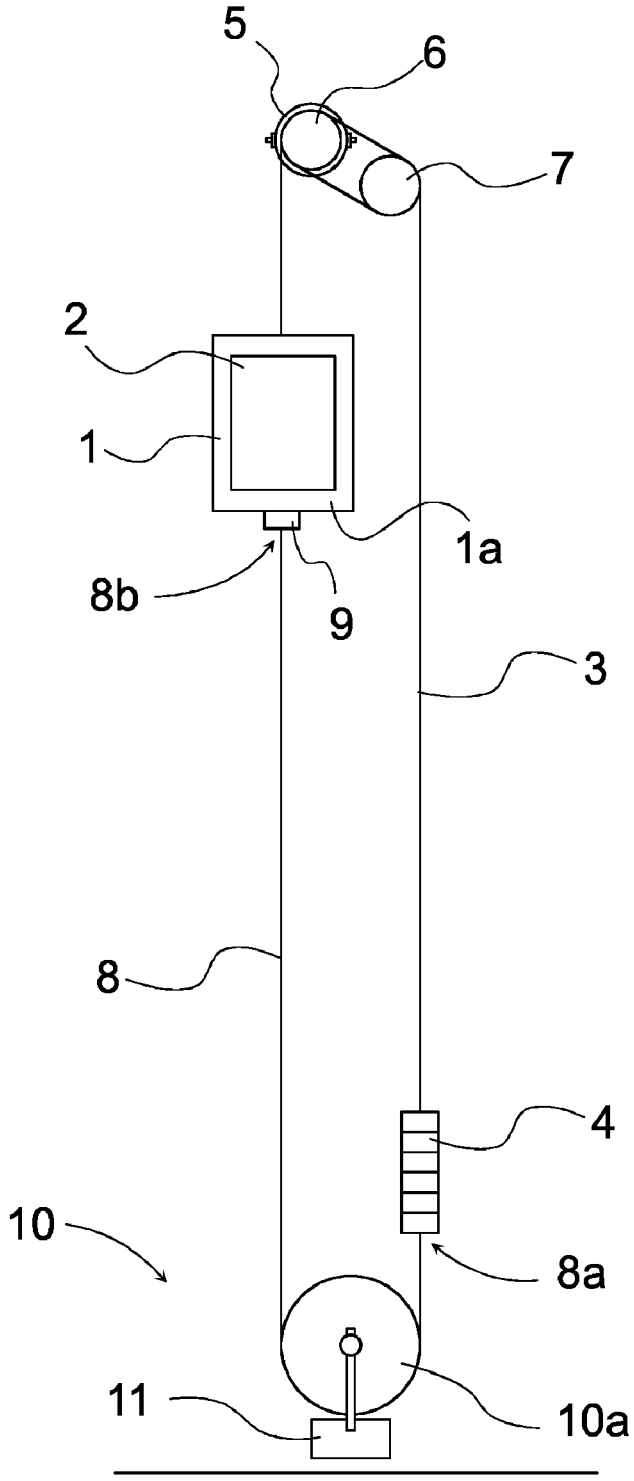

| | | | | |
|---|---|---|---|---|
| 6,854,164 | B2 * | 2/2005 | Bass et al. | 24/136 R |
| 2006/0249337 | A1 * | 11/2006 | McNamara et al. | 187/412 |

FOREIGN PATENT DOCUMENTS

| | | | | |
|---|---|---|---|---|
| JP | 55-166552 | A | | 12/1980 |
| JP | 55166552 | A | * | 12/1980 |
| JP | 7-228448 | A | | 8/1995 |
| JP | 2005306586 | A | * | 11/2005 |

OTHER PUBLICATIONS

Written Opinion of the International Searching Authority PCT/ISA/237, for PCT/FI2009/000075 mailed Nov. 9, 2009.

* cited by examiner

METHOD AND ARRANGEMENT FOR FIXING THE COMPENSATING ROPES OF AN ELEVATOR

Cross Reference to Related Applications:

This application is a Continuation of PCT International Application No. PCT/FI2009/000075 filed on Aug. 11, 2009, which claims the benefit of Patent Application No. 20080464 filed in Finland, on Aug. 13, 2008. The entire contents of all of the above applications is hereby incorporated by reference into the present application.

The present invention relates to a method as defined in the preamble of claim 1 and an arrangement as defined in the preamble of claim 5 for fixing the compensating ropes of an elevator.

In traction sheave elevators with counterweight the weight of the hoisting roping produces an imbalance between the elevator car and the counterweight when the height difference between the elevator car and the counterweight is great. The imbalance is at its greatest when the elevator car is in the top part of the elevator hoistway and the counterweight is in the bottom part of the hoistway, or vice versa. This is a problem in elevators of large travel heights because these elevators comprise long and heavy hoisting ropes. Owing to the great height difference between the elevator car and the counterweight as well as to the heavy hoisting ropes, the imbalance can increase to be so large that the friction between the hoisting ropes and the rope grooves of the traction sheave is not sufficient, in which case the hoisting roping starts to slip on the traction sheave. In elevators of smaller travel heights the imbalance caused by the hoisting roping is not of substantial importance because it is relatively small, so that it can be ignored, but the large imbalance produced with larger travel heights must be compensated in some way. The aforementioned imbalance must generally be compensated in elevators in which the travel height is greater than a certain height. In some elevator solutions a travel height of just 30-40 meters necessitates compensation of the imbalance.

In prior art the imbalance between the elevator car and the counterweight is compensated with so-called compensating ropes, which are fixed at their first ends to the bottom part of the elevator car and at their second ends to the bottom part of the counterweight. When the elevator car is in the bottom part of the elevator hoistway, the counterweight is in the top part of the hoistway, and the part of the hoisting rope on the elevator car side of the traction sheave in the top part of the hoistway is long and heavy. In this case, however, the compensating ropes hanging from the bottom part of the counterweight are also long and heavy, in which case they compensate the imbalance produced by the hoisting roping in the rope forces on the traction sheave. The compensating ropes do not necessarily hang freely in the hoistway. In fast and high-rise elevators, the bottom part of the elevator hoistway comprises a compensating pulley fitted to move in the vertical direction guided by the guide rails, under which compensating pulley the compensating ropes are fitted to pass. A tensioning weight, which is arranged to keep the compensating ropes at the desired tension, is also normally fitted in connection with the compensating pulley.

A problem in these solutions is that the fixing location of the compensating ropes below the elevator car is generally very cramped, in which case the fixing of the ends of the compensating ropes is difficult. Another problem is that a sufficiently large vertical space must be left below the elevator car for fixing the ends of the compensating ropes. This type of hoistway space that must be constructed purely for the fixing of the compensating rope is unnecessarily expensive. When striving for bottom clearances of the elevator hoistway, i.e. spaces which remain below the elevator car when the elevator car is in its bottom position, that are as shallow as possible the vertical space required by the fixing of the ends of the compensating ropes hampers achievement of the optimal depth of the bottom clearance in relation to other criteria. A further problem is that the prior-art fixings of the ends of the compensating ropes are not adjustable in the horizontal direction. In this case problems may arise in balancing the elevator car, in which case the balancing must be performed by means of additional weights or with other solutions that raise costs.

The object of this invention is to eliminate the aforementioned drawbacks and to achieve a simple and inexpensive method and arrangement for fixing the compensating ropes of an elevator, in which arrangement the fixing solution does not take much space in the height direction of the elevator hoistway and enables easy fixing into position of the compensating ropes as well as at the same time easy horizontal adjustment of the fixing points of the ends of the compensating ropes in both the depth direction and the transverse direction of the elevator car. The method according to the invention is characterized by what is disclosed in the characterization part of claim 1. Correspondingly, the arrangement of the invention is characterized by what is disclosed in the characterization part of claim 5. Other embodiments of the invention are characterized by what is disclosed in the other claims.

Some inventive embodiments are also discussed in the descriptive section of the present application. The inventive content of the application can also be defined differently than in the claims presented below. The inventive content may also consist of several separate inventions, especially if the invention is considered in the light of expressions or implicit subtasks or from the point of view of advantages or categories of advantages achieved. In this case, some of the attributes contained in the claims below may be superfluous from the point of view of separate inventive concepts. Likewise the different details presented in connection with each embodiment can also be applied in other embodiments. In addition it can be stated that at least some of the subordinate claims can in at least some situations be deemed to be inventive in their own right.

In the following the method and the arrangement according to the invention are referred to jointly as the solution according to the invention. One advantage of the solution according to the invention is that a lot of valuable space is saved in the bottom part of the elevator hoistway, because the solution for fixing the ends of the compensating ropes is shallower than prior-art solutions. Another advantage is that the compensating ropes can be fixed into position in connection with the elevator car when the fixing base of the ropes is on the elevator car or fixed in connection with it. In this case the dimensioning of the compensating ropes is considerably easier and faster than in prior-art solutions. When the wedge housings of the compensating ropes are turned to the side or at least inclined away from the actual operating attitude, one advantage is also the easy fixing of the ends of the compensating ropes, which can be performed from the side or obliquely from the side, in which case the end of the ropes can be placed into the wedge housing as a large loop and using relatively little force. Yet another advantage is that an optimal fixing point for the compensating ropes, in both the depth direction and in the transverse direction of the elevator car, is easily found with the solution according to the invention, because these horizontal adjustments are easy to perform in connection with the fixing of the ends of the ropes. The solution according to the invention is thus applicable also in fixing the compensating ropes to the counterweight, in which case in the invention the compensating ropes are fixed to the frame of the counterweight or to another structure in the same way as is now presented for fixing them to the structure of the elevator car.

Figure 2:
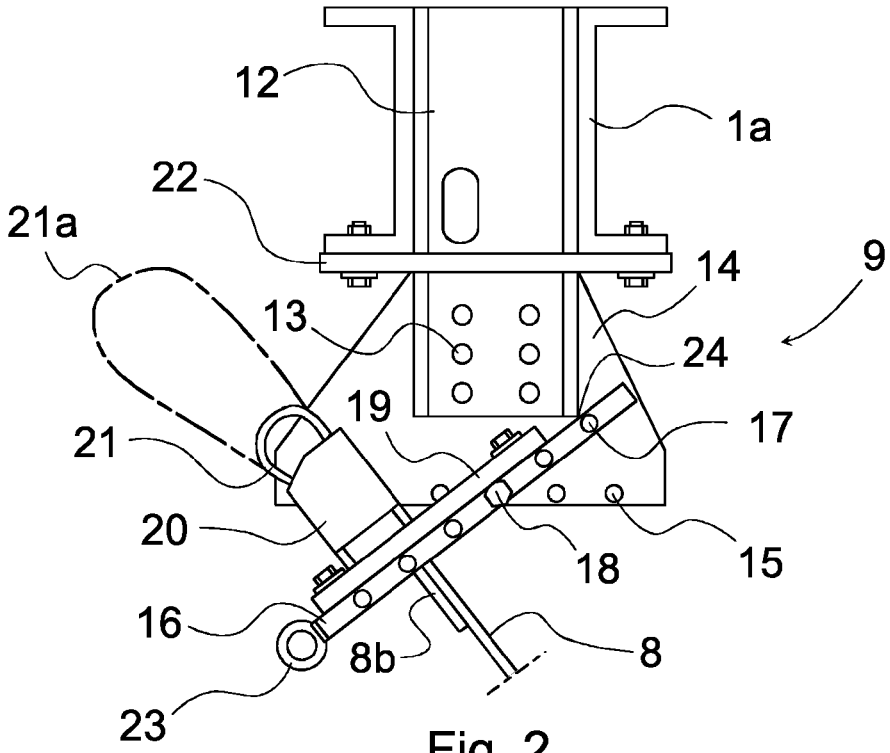
Figure 3:
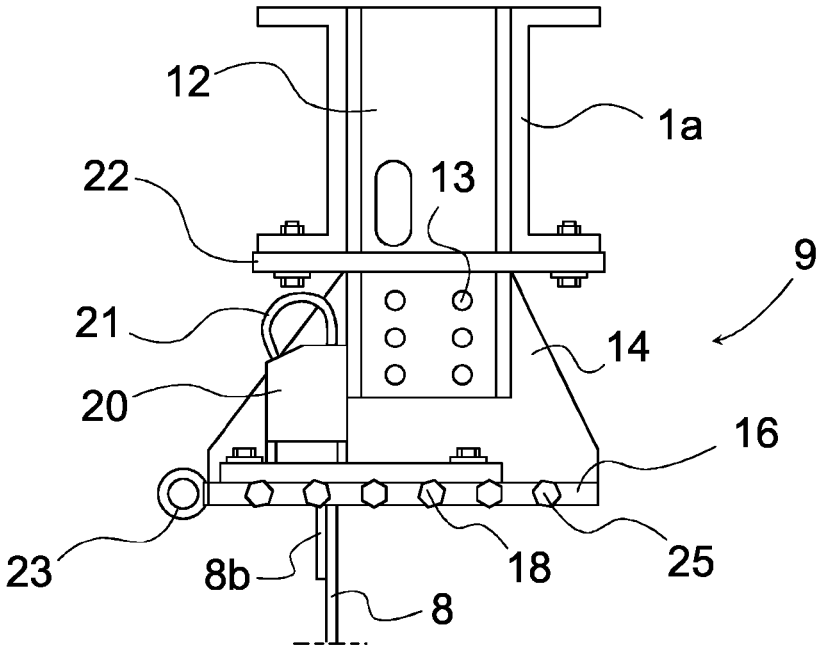
Figure 4:
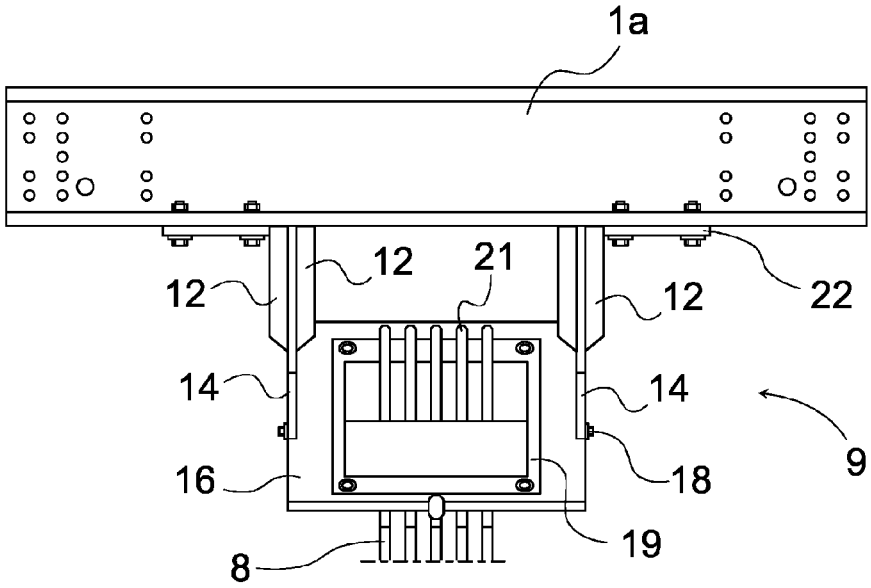
Figure 5:
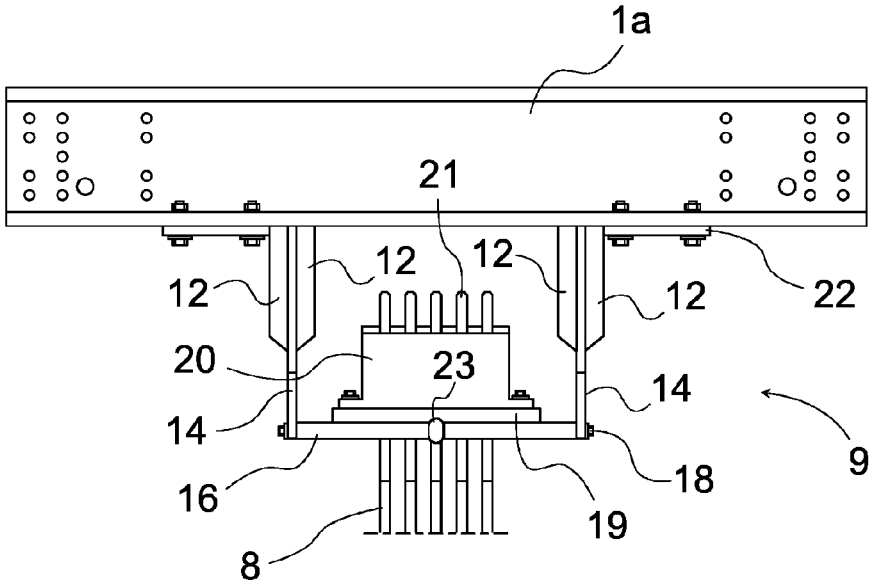

In the following, the invention will be described in detail by the aid of one example of its embodiment with reference to the attached drawings, wherein FIG. 1 presents a simplified side view of one elevator provided with compensating ropes, FIG. 2 presents a simplified side view of a fixing solution of the ends of the compensating ropes according to the invention on the elevator car side in the fixing phase of the compensating ropes, FIG. 3 presents a simplified side view of a fixing solution of the ends of the compensating ropes according to the invention on the elevator car side after the fixing of the compensating ropes, FIG. 4 presents a simplified front view of a fixing solution of the ends of the compensating ropes according to the invention on the elevator car side in the fixing phase of the compensating ropes, and FIG. 5 presents a simplified front view of a fixing solution of the ends of the compensating ropes according to the invention on the elevator car side after the fixing of the compensating ropes.

FIG. 1 presents a simplified side view of one elevator solution in which compensating ropes are used. The elevator is a normal traction sheave elevator with counterweight, in which the elevator car 2 as well as the counterweight 4 are suspended on hoisting roping 3. The elevator receives its lifting force from the hoisting machine 6 as a result of the friction between the traction sheave 5 and the hoisting roping 3. The hoisting roping 3 is fixed at its first end to the top part of the elevator car 2 provided with a car sling 1, from where is led to pass around the top of the traction sheave 5, after which around the diverting pulley 7 disposed in connection with the hoisting machine 6 of the elevator, and from there again around the top of the traction sheave 5. After this the hoisting roping 3 is led over the diverting pulley 7 down towards the counterweight 4, to the top part of which the second end of the hoisting roping 3 is fixed.

The compensating ropes 8 are fixed at the first ends 8*a* to the bottom part of the counterweight 4, from where they are led below the compensating pulley 10*a* incorporated in the compensation apparatus 10, after which upwards to the elevator car 2, and the compensating ropes 8 are fixed at their second ends 8*b* to the bottom beam 1*a* of the car sling 1 on the bottom part of which elevator car by means of a fixing base 9. A tensioning weight 11 or corresponding tensioning apparatus incorporated in the compensation apparatus 10 is also fixed in connection with the compensating pulley 10*a*, which tensioning weight is arranged to keep the compensating ropes 8 at the desired tension. The compensating pulley 10*a* is disposed e.g. inside a frame fixed to the bottom of the hoistway, which frame comprises guides, guided by which the compensating pulley 10*a* is fitted to move in the vertical direction. This frame, however, is omitted from FIG. 1 for the sake of clarity.

FIGS. 2-5 present simplified, partly sectioned side and front views of a fixing solution of the second ends 8*b* of the compensating ropes 8 according to the invention on the elevator car 2 side in the fixing phase of the ends of the compensating ropes 8 on the elevator car side and after the fixing. For the sake of clarity, the second suspension means 14 that is closer to the viewer is cut completely away so that the parts between the suspension means can be seen clearly enough.

For the purpose of fixing the second ends 8*b* of the compensating ropes 8, a fixing base 9 is fixed to the bottom beam 1*a* of the car sling 1 of the elevator, in as optimal a location as possible in relation to the balance of the elevator car 2 in the longitudinal direction of the bottom beam 1*a*, by means of bracket elements 12. The bracket elements 12 are e.g. beams of a U-profile, which are fixed at their top part to the bottom beam 1*a* in a vertical position and into the fixing holes 13 in the bottom part of which bracket elements 12 the fixing base 9 of the second ends 8*b* of the compensating ropes 8 is fixed e.g. with a bolt-nut fixing.

The fixing base 9 comprises e.g. two plate-like suspension means 14 that are at a distance from each other and which are fixed at their top ends to the fixing holes 13 of the bracket elements 12, and the bottom edge of which suspension means comprises a plurality of fixing holes 15 at set intervals in row shape. As viewed from the side, i.e. in the longitudinal direction of the bottom beam 1*a*, the suspension means 14 are asymmetrical in relation to the vertical line of the car sling 1, which asymmetry enables easy adjustment of the second ends of the compensating rope 8 in the depth direction of the elevator car 2 simply by turning the suspension means 14 around 180 degrees in the vertical plane.

A, for example, plate-like bracket 16 of the wedge housings 20 of the compensating ropes 8, that is bent downwards at its edges is fixed to the holes 15 of the suspension means 14. The bracket 16 comprises a plurality of fixing holes 17 disposed at set intervals from each other, the size of which and the distance from each other of which are essentially the same as the size of and the distance from each other of the fixing holes 15 of the suspension means 14. In this way the bracket 16 is arranged to be fixed to the holes 15 of the suspension means 14 by its fixing holes 17 e.g. with a bolt-nut fixing 24.

The top surface of the bracket 16 comprises a support plate 19, onto the top of which support plate the wedge housings that are used for fixing the second ends 8*b* of the compensating ropes 8 are fixed in one or more rows side by side. In addition, the front edge of the bracket 16 comprises a loop 23, by means of which the bracket 16 can be turned around its hinge 18. There can also be support plates 22 as an additional reinforcement in the structure, which support plates are fixed e.g. with a screw fixing to the bottom surface of the bottom beam 1*a* in connection with the bracket elements 12.

FIGS. 2 and 4 present a situation in which the second ends 8*a* of the compensating ropes 8 are just being fixed to the wedge housings 20. For the purposes of fixing, the bracket 16 is hinged to the fixing holes 15 of the suspension means with one bolt 18, which is disposed in some inner fixing hole 17 of the bracket 16, e.g. in the third fixing hole 17 counting from the second end such that the bolt 18 forms a pivot-type essentially horizontal hinge, around which the bracket 16 can be turned in the vertical plane. The bracket and the support plate 19 comprise suitable holes for passing through the second ends 8*b* of the compensating ropes 8, first in the second direction and then back, which holes are in essentially the same location to each other.

When fixing the ends of the compensating ropes 8, the bracket 16 is turned around the hinge formed by the bolt 18 into an inclined attitude to the side of the bottom beam 1*a* such that the wedge housings 20 point at an angle upwards and away from the bottom beam 1*a*. The bottom corners of the bracket elements 12 are arranged to function as a stop 24 for preventing too much turning of the bracket 16. In this case the stop 24 functions as a safety device, so that the weight of the compensating ropes 8 does not manage to pull the bracket 16 in an uncontrolled manner into an angle that is too inclined.

After this it is easy to bend the end 8*b* of the compensating rope 8 first into a larger loop 21*a* and then to press its free end into the wedge housing 20 together with the wedge in an inclined attitude with respect to the vertical direction, in which case a small loop 21 remains above the wedge housing 20. The free end 8*b* threaded through the wedge housing 20 is fixed to the corresponding compensating rope 8 below the wedge housing 20 and the bracket 16. When all the ends 8*b* of the compensating ropes 8 are fixed in this way, the bracket 16 is turned around the hinge formed by the bolt into its essentially horizontal normal position and is fixed into position suspended on the suspension means 14 by the aid of the bolts and fixing nuts 24 disposed in the holes 15 and 17.

It can be generalized from the above that in the method according to the invention when fixing the ends 8*b* of the compensating ropes 8 in connection with the elevator car 2, the wedge housings 20 are turned into an inclined attitude before disposing the ends 8*b* of the compensating ropes 8 in the wedge housings 20.

If the compensating ropes must be replaced, the bolts other than the bolt 18 that functions as a hinge are detached and the bracket 16 is turned around the hinge formed by the bolt into an inclined position, and also the rope to be replaced is detached and a new rope or new ropes is put in its place, after which the bracket 16 is again turned into its normal position and is locked in position by means of the bolts and fixing nuts 24 disposed in the holes 15 and 17.

Horizontal adjustment of the fixing of the second ends 8*b* of the compensating ropes 8 is performed in the depth direction of the elevator car 2, i.e. transversely with respect to the longitudinal direction of the bottom beam 1*a*, in two different ways. Either with the aforementioned method by turning the suspension means 14 around 180 degrees in the vertical plane before fixing the bracket 16 to the suspension means 14, or by moving the bracket 16 in relation to the fixing holes 15 in the depth direction of the elevator car 2. Thus the adjustment is very versatile.

Correspondingly, horizontal adjustment of the fixing of the second ends 8*b* of the compensating ropes 8 in the longitudinal direction of the bottom beam 1*a* is performed by disposing the bracket elements 12 in a suitable location with regard to horizontal adjustment in the longitudinal direction of the bottom beam 1*a*.

It is obvious to the person skilled in the art that different embodiments of the invention are not limited to the example described above, but that they may be varied within the scope of the claims presented below. Thus, for example, the bracket of the wedge housings can be different to what is presented above. Instead of being a plate structure bent at its ends, it can be one thick plate or e.g. a plate on the bottom surface of which is a plurality of pipes that correspond to the holes in the edges of the plate or that go through the plate.

It is further obvious to the person skilled in the art that the wedge housings can be in more than one row, e.g. in two rows side by side.

It is also obvious to the person skilled in the art that the fixing base can be structurally and functionally different to what is described above.

The invention claimed is:

1. A method for fixing compensating ropes of an elevator to an elevator car and a counterweight, wherein the elevator comprises at least a hoisting machine and hoisting roping, on which the elevator car and counterweight are arranged and suspended to travel in a respective vertical direction, and between the elevator car and the counterweight compensating ropes are fixed such that first ends of the compensating ropes are fixed to the counterweight, from where the compensating ropes are led downwards, to pass below a compensating pulley, after which the compensating ropes are led upwards to the elevator car, where second ends of the compensating ropes are fixed in connection with the elevator car by wedge housings, wherein when fixing the ends of the compensating ropes in connection with the elevator car or with the counterweight, the wedge housings are pivoted into an inclined attitude with respect to the vertical direction, before disposing the ends of the compensating ropes in the wedge housings.

2. The method according to claim 1, wherein, when fixing the ends of the compensating ropes in connection with the elevator car, the wedge housings are pivoted around a hinge, into the inclined attitude, such that the wedge housings point upwards at an angle, after which the ends of the compensating ropes are bent and pushed together with wedges into the wedge housings in the inclined attitude with respect to the vertical direction.

3. The method according to claim 2, wherein, when fixing the ends of the compensating ropes in connection with the elevator car, the wedge housings are pivoted into the inclined attitude by a hinge of a bracket, said bracket suspended on a bottom beam of the elevator car, the ends of the compensating ropes are fixed in the wedge housings and when all the ends of the compensating ropes are fixed, the bracket is pivoted by the hinge into an essential horizontal position and is also fixed to a suspension device that is fixed to the bottom beam of the elevator car.

4. The method according to claim 2, wherein a fixing location of the ends of the compensating ropes is adjusted in a horizontal direction along a depth direction of the elevator car by moving a bracket of the wedge housings in the depth direction of the elevator car or by turning the suspension device around 180 degrees in the vertical plane before fixing the bracket to the suspension device.

5. The method according to claim 1, wherein, when fixing the ends of the compensating ropes in connection with the elevator car, the wedge housings are pivoted into the inclined attitude by a hinge of a bracket, said bracket suspended on a bottom beam of the elevator car, the ends of the compensating ropes are fixed in the wedge housings and when all the ends of the compensating ropes are fixed, the bracket is pivoted by the hinge into an essentially horizontal position and is also fixed to a suspension device that is fixed to the bottom beam of the elevator car.

6. The method according to claim 5, wherein a fixing location of the ends of the compensating ropes is adjusted in a horizontal direction along a depth direction of the elevator car by moving a bracket of the wedge housings in the depth direction of the elevator car or by turning the suspension device around 180 degrees in the vertical plane before fixing the bracket to the suspension device.

7. The method according to claim 1, wherein a fixing location of the ends of the compensating ropes is adjusted in a horizontal direction along a depth direction of the elevator car by moving a bracket of the wedge housings in the depth direction of the elevator car or by turning the suspension device around 180 degrees in the vertical plane before fixing the bracket to the suspension device.

8. An arrangement for fixing compensating ropes of an elevator to an elevator car and to a counterweight, wherein the elevator comprises at least a hoisting machine and hoisting roping, on which the elevator car and counterweight are arranged and suspended to travel in a vertical direction, and between the elevator car and the counterweight at least compensating ropes are fixed such that first ends of the compensating ropes are fixed to the counterweight, from where the compensating ropes are led downwards to pass below a compensating pulley, after which the compensating ropes are led upwards to the elevator car, where second ends of the compensating ropes are fixed by wedge housings in connection with the elevator car, wherein the wedge housings are arranged to be pivoted into an inclined attitude with respect to the vertical direction, for fixing the ends of the compensating ropes in connection with the elevator car or the counterweight.

9. The arrangement according to claim 8, wherein the fixing base comprises a bracket for the wedge housings, and the bracket is suspended from a bottom beam of a car sling of the elevator car via a plurality of suspension devices provided with fixing holes.

10. The arrangement according to claim 9, wherein bracket elements that are adjustable in a longitudinal direction of the bottom beam are fixed to the bottom beam of the elevator car, and top ends of the suspension device are fixed to the bracket elements.

11. The arrangement according to claim 10, wherein a bottom corner of the bracket elements is arranged to function as a stop for preventing pivoting of the bracket in an uncontrolled manner by a weight of the compensating ropes.

12. The arrangement according to claim 9, wherein the fixing holes of the suspension devices are arranged at set intervals from each other and are disposed along a horizontal direction and asymmetrically with respect to a vertical center line of the bottom beam.

13. The arrangement according to claim 9, wherein the bracket of the wedge housings comprises a plurality of fixing holes disposed at set intervals from each other, a size of which and a distance from each other of which are essentially the same as the size of and the distance from each other of the fixing holes of the suspension devices.

14. The arrangement according to claim 9, wherein the bracket is arranged to be fixed to the suspension devices at stepped intervals that correspond to a distance between the fixing holes.

15. The arrangement according to claim 8, wherein the wedge housings are fixed to a fixing base, which is provided with a hinge, for pivoting the fixing base into the inclined attitude for purpose of fixing the second ends of the compensating ropes to the elevator car.

16. The arrangement according to claim 15, wherein the fixing base comprises a bracket of the wedge housings, and the bracket is suspended from a bottom beam of a car sling of the elevator car at least via a plurality of suspension devices provided with fixing holes.

17. The arrangement according to claim 16, wherein the fixing holes of the suspension devices are arranged at set intervals from each other and to be disposed along a horizontal direction and asymmetrically with respect to a vertical center line of the bottom beam.

* * * * *